United States Patent [19]

Huang

[11] 4,280,171

[45] Jul. 21, 1981

[54] DECORATIVE SPECULAR ILLUMINATOR

[76] Inventor: Thomas N. Huang, 6, Lin 1, Fu-Hsing Li, Ta Sih Town, Tao-Yuan County, Taiwan, Taiwan

[21] Appl. No.: 80,576

[22] Filed: Oct. 1, 1979

[51] Int. Cl.[3] ..... F21V 1/00

[52] U.S. Cl. ..... 362/240; 362/241; 362/346; 362/367; 362/806

[58] Field of Search ..... 362/240, 241, 346, 367, 362/806, 811

[56] References Cited

U.S. PATENT DOCUMENTS 3,611,603 10/1971 Gesner ..... 362/806

*Primary Examiner*—Donald P. Walsh

[57] ABSTRACT

A specular illuminator having a plurality of bulbs surrounded by a plurality of glass panes coated with a light-filtering resin on their inner surfaces. When the bulbs are not glowing, the glass surrounding them may be used as a mirror since the outer surface, not coated with light-filtering resin, can reflect the image; when the bulbs are glowing, the light will shine forth through the glass and, at the same time, reflect repetitively among the inner surface of the glass and project an image of numerous bulbs on the outer surface of the glass. With the application of bulbs of different colors and shapes or other ornaments, the reflection will look even more glaring.

4 Claims, 2 Drawing Figures

DECORATIVE SPECULAR ILLUMINATOR

BACKGROUND OF THE INVENTION

This invention relates to a specular illuminator comprising a plurality panes of bulbs surrounded by a plurality of glass coated with light-filtering resin on their inner surfaces. With the multiple reflection among the glass, the bulbs inside the glass combination will appear as an image of numerous bulbs on the outer surface of the glass.

Along with the rapid progress of industry, the population of the city has expanded to such a degree that the space allowed for each person decreases in a large scale and forms a kind of spacial pressure on people. Accordingly, how to make good use of the limited space so as to enlarge people's visual territory has been the major concern of architectures and interior designers.

SUMMARY OF THE INVENTION

It is a primary object of the present invention to provide a decorative illuminator which can enlarge people's visual scope by presenting a sense of large quantity within a limited space.

It is another object of the present invention to provide a decorative illuminator which presents a glaring image of numerous bulbs to serve the decorative purpose.

It is still another object of this invention to provide a decorative illuminator which can also be used as a mirror.

According to this invention, the decorative illuminator is formed with a certain number of bulbs surrounded by a plurality of glass panes coated with light-filtering resin on their inner surface. When the bulbs are glowing, through multiple reflections occurring among the glass panes, the light will project outwardly to form an image of numerous bulbs on the outer surface of the glass. When the bulbs are extinguished, the light-filtering resin layer will keep the outside light from coming into the illuminator; being dark on the inside of the illuminator, the outer surface of the glass can therefore be used as a mirror.

These and other features and objects of the invention will become more apparent and well-understood from a preferred embodiment of the invention accompanying with drawings in which:

DETAILED DESCRIPTION OF THE DRAWING

Figure 1:
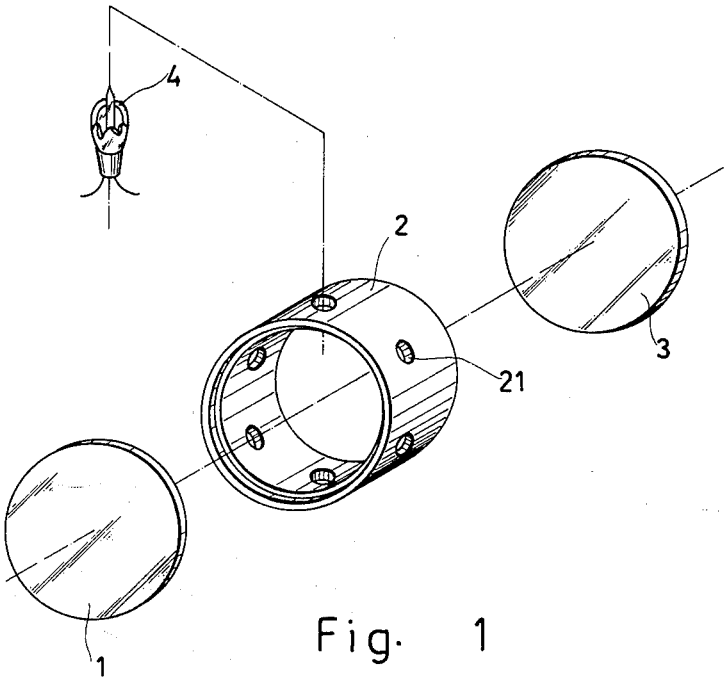
FIG. 1 is an exploded view of the preferred embodiment.
Figure 2:
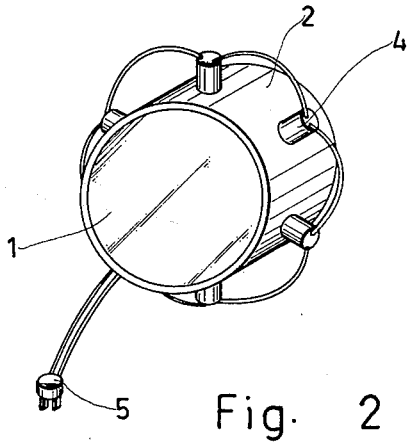
FIG. 2 is a perspective view of the preferred embodiment.

In FIG. 1 there is shown two panes or pieces of glass 1, 3 whose surfaces are coated with a layer of light-filtering resin on one side, and a plurality of holes 21 provided around a frame 2 for inserting and fixing bulbs 4 or other ornaments. As shown in FIG. 2, the two pieces of glass 1, 3 are attached to each end of frame 2 with their surface coating with light-filtering resin facing toward each other; in the holes around the frame 2 there are a plurality of bulbs 4 inserting therein. Since the inside of the frame 2 is darker than the outside, the outer surface of the two pieces of glass 1, 3 can be used as a mirror due to its clear reflection of the image. If the bulbs 4 are turned on by plugging in the connector 5, the bulbs 4 and other ornaments attaching to the frame 2 will result in a glaring cubic visual effect from the multiple reflection occurring between the two pieces of glass panes 1, 3.

The bulbs 4 may be surrounded by glass from two sides, three sides, or even multiple sides, and the shape of the glass combination can be cubic, round, pyramidal, conical, cylindric, truncated pyramidal or any other irregular shape depending on the decorative purpose and principle of beauty. After the bulbs are switched on, the light will be reflecting repetitively and the image of numerous bulbs will be shown on the outer surface of the glass. Since the number of bulbs is indefinite, the limited space is englarged visually. If the bulbs are of different colors and shapes, or ornaments are hung inside the frame, the image will be even more glamorous and the decorative effect will be maximized.

Of course, since light is both reflected from the external surface of glass panes 1, 3 and multiply reflected within the illuminator and since light can also pass through panes 1, 3, the layer of resin should provide partial reflectivity to light impinging panes 1, 3 from either direction.

This invention can be applied to other objects, such as an aquarium, to achieve various cubic effects.

While a preferred embodiment of the invention has been described using specific terms, such description is for illustrative purposes only, and it is to be understood that changes and variations may be made without departing from the spirit or scope of the following claims.

I claim:

1. A decorative illuminator comprising:

(a) at least a pair of panes capable of passing visible light, said panes having a layer of light-filtering resin disposed thereon, said layer partially reflecting light impinging both the side of the layer adjacent the pane and the side away from the pane;

(b) means for disposing said panes essentially parallel to each other; and (c) means for disposing a plurality of bulbs between said panes, whereby light from the bulbs will project outwardly to form an image of numerous bulbs on the outer surface of the panes due to multiple reflections occurring among the panes.

2. A decorative illuminator as in claim 1, wherein said bulbs have different colors and shapes.

3. A decorative illuminator as in claims 1 or 2, further including a plurality of ornaments disposed between said panes.

4. A planar mirror comprising a plurality of bulbs surrounded by a plurality of panes capable of passing visible light disposed with their inner surfaces facing each other and defining a region therebetween, each said inner surface having a layer of light-filtering resin coated thereon and each said layer partially reflecting light impinging it both at its surface facing the adjacent pane and the surface away from the pane; said inner surface of the panes inhibiting light from entering said region; whereby when said bulbs are not glowing, the region between the panes is darker than the outside, and the resin coated panes mirror and reflect light impinging the panes.

* * * * *